US007402263B2

(12) United States Patent
Myers et al.

(10) Patent No.: US 7,402,263 B2
(45) Date of Patent: Jul. 22, 2008

(54) TUNGSTATE BASED CORROSION INHIBITORS

(75) Inventors: Craig W. Myers, Lisle, IL (US); Steven R. Hatch, Naperville, IL (US); Donald A. Johnson, Batavia, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 11/113,742

(22) Filed: Apr. 25, 2005

(65) Prior Publication Data

US 2006/0237684 A1 Oct. 26, 2006

(51) Int. Cl.

| | |
|---|---|
| ***H01B 1/00*** | (2006.01) |
| ***C09K 3/00*** | (2006.01) |
| ***C23F 11/00*** | (2006.01) |
| ***C05C 9/00*** | (2006.01) |
| ***C05B 15/00*** | (2006.01) |

(52) U.S. Cl. ..... 252/500; 252/387; 252/394; 71/28; 71/29; 71/30

(58) Field of Classification Search ..... 510/401, 510/185, 195, 245, 363; 71/28, 29, 30, 61; 252/500, 387, 394

See application file for complete search history.

(56) References Cited

U.S. PATENT DOCUMENTS

| | | | | |
|---|---|---|---|---|
| 3,790,610 | A * | 2/1974 | Lum et al. | 556/31 |
| 4,289,634 | A * | 9/1981 | Lewis et al. | 508/436 |
| 4,409,121 | A * | 10/1983 | Latos et al. | 252/389.2 |
| 4,659,481 | A * | 4/1987 | Chen | 210/697 |
| 5,047,078 | A * | 9/1991 | Gill | 71/11 |
| 5,288,410 | A * | 2/1994 | Cuisia | 210/699 |
| 5,376,159 | A | 12/1994 | Cunningham et al. | |
| 6,007,772 | A * | 12/1999 | Green | 422/29 |
| 6,623,695 | B2 * | 9/2003 | Malchesky et al. | 422/12 |
| 6,953,537 | B2 * | 10/2005 | Trahan et al. | 252/389.22 |
| 2003/0230742 | A1 | 12/2003 | Trahan et al. | |

FOREIGN PATENT DOCUMENTS

RU 2048461 C1 * 11/1995

OTHER PUBLICATIONS

B. Jabeera et al., "The synergistic inhibitive effect of tungstate with zinc ions on the corrosion of iron in aqueous environments," Anti-Corrosion Methods and Materials, vol. 49, pp. 408-416, 2002.*

Zhavoronkova et al., "Corrosion of materials in urea-ammonium mixtures," Cherepovets. Azotmotukovyi Zavod, Cherepovets, USSR, Khimozatsiya Sel'skogo Khozyaistva, 1989, vol. 6, pp. 48-49.

English abstract of Zhavoronkova et al., "Corrosion of materials in urea-ammonium mixtures," Cherepovets. Azotmotukovyi Zavod, Cherepovets, USSR, Khimozatsiya Sel'skogo Khozyaistva, 1989, vol. 6, pp. 48-49.

Cahoon, J. R., "Corrosion characteristics of mild steel in urea ammonium nitrate fertilizer solutions," *Corrosion*, Houston, 2002, vol. 58, No. 2, pp. 166-174.

Nguyen, D. T., "Corrosion of liquid fertilizers on metallic materials," American Chemical Society National Meeting, Sep. 1997.

* cited by examiner

*Primary Examiner*—Lorna M. Douyon
*Assistant Examiner*—Jaison P Thomas
(74) *Attorney, Agent, or Firm*—Edward O. Yonter; Peter A. DiMattia; Michael B. Martin

(57) ABSTRACT

A trace amount of a tungstate is disclosed for inhibiting corrosion by nitrogen fertilizer solution, in particular, an ammonium nitrate fertilizer solution, (UAN) in contact with ferrous metal storage tanks, piping, and equipment surfaces. Tungstate added with a dispersant polymer is also effective for inhibiting corrosion.

18 Claims, No Drawings

TUNGSTATE BASED CORROSION INHIBITORS

FIELD OF THE INVENTION

This invention relates to a tungstate based corrosion inhibitor for nitrogen fertilizer solutions, and more particularly to inhibiting corrosion by urea ammonium nitrate solutions.

BACKGROUND OF THE INVENTION

Nitrogen solutions represent an important class of fertilizers. A commercially popular nitrogen fertilizer solution is made from urea and ammonium nitrate, often referred to as UAN. The UAN does not need to be kept under pressure, and can be applied directly for agricultural purposes.

The production of UAN solutions is straightforward, comprising blending urea solution, ammonium nitrate solution and any additional water in a mixing tank, in either a batch or a continuous process. Ammonia is sometimes also added to adjust the pH. Mixtures of ammonium nitrate and urea have much greater solubility as compared to that of either material alone. The UAN is typically manufactured with 20% by weight water and (32% Total Nitrogen Content,), but for field application is diluted with water to 28% Total Nitrogen Content. The economics of such solutions are relatively attractive in comparison to solids because evaporation is decreased and granulation, drying and conditioning are not necessary.

One problem that has been persistent in the production, storage, transportation and use of UAN has been that the UAN liquid is corrosive to carbon steel. Without adequate corrosion inhibition, UAN solutions in ferrous tanks or piping systems can become colored within a matter of days, usually orange or reddish indicating iron corrosion. This problem in ammonium nitrate (AN) and UAN solutions has been the subject of several reported corrosion studies over the last 50 years. (Vreeland et al., 1956; Novak et al., 1984; and Cahoon, 2002). The behavior of UAN solutions and AN solutions have been found to be similar in these studies. However, the actual inhibitors tested are often listed as "proprietary compounds," and thus the studies are of limited value. The corrosive effect of AN and UAN on various metallurgies has also been reported. (Zavoronkova et al., 1989).

However, the actual corrosion of field equipment, e.g. storage tanks, can be substantially more complicated than laboratory electrochemical studies may indicate. In particular, sludge that collects in low spots on the tank floor, such as the chine weld connecting the tank walls to the floor or along the lower plate of a lap weld, seems to be important in contributing to the pitting corrosion that is often observed in these areas. Sludge can be formed by corrosion product (rust) particles that drop off the tank walls to the bottom of the UAN storage vessel, creating these sludge deposits on the vessel bottom over time. It is therefore particularly useful for a corrosion inhibitor to be able to reduce the generation of particulate matter associated with even small amounts of corrosion in UAN storage and transportation vessels (e.g. rail cars).

In the past, several general types of corrosion inhibitors have been used in urea ammonium nitrate solutions. High levels (hundreds or thousands of mg/kg) of phosphate or polyphosphate salts were employed early on by the industry. This approach eventually fell into disfavor due to the production of precipitates of the phosphates with other ionic constituents such as iron, calcium, magnesium, etc. These precipitates lead to unfavorable deposits on the bottom of storage vessels (as noted above) as well as plugging of spray application devices.

Various types of filming inhibitors (a.k.a. "filmers"), in particular phosphated esters and the like, were the next generation of treatment technology (Hallander et al., 2002). Many different types of filmers have been employed, but these filmers typically have three drawbacks. First, due to their surfactant nature, they may contribute to undesirable foaming during loading/unloading of the UAN. Second, the hydrophobic character of the uncharged end of the molecule may lead to preferential absorption into floating oil layers that are often found on the top of UAN in storage. These oil layers are formed over time by small oil leaks from the compressors used in manufacturing the UAN raw materials. Third, the filmers may have difficulty penetrating existing sludge layers to inhibit under-deposit corrosion on a tank bottom.

The next generation of inhibitors were based on molybdate (Cunningham et al., 1994), which passivates the corroding metal surface by forming a surface complex with iron (Hartwick et al., 1991). In actual applications, molybdate has the advantage that it seems to give good penetration of existing sludge layers to inhibit under-deposit corrosion on tank bottoms. Molybdate has the additional advantage that it is a plant micronutrient. However, the cost of this type of treatment is currently unacceptable due to the steep rise in molybdate costs over the last 2 years.

SUMMARY OF THE INVENTION

It has been found that a trace amount of a tungstate can effectively inhibit corrosion by a nitrogen fertilizer solution of ferrous metal surfaces in contact with this solution during storage, transport, or other processing of this fertilizer solution. Nitrogen fertilizer solutions containing an effective amount of the tungstate for corrosion inhibition are non-foaming and can be made essentially free of precipitates.

Accordingly, in one aspect the present invention provides a method for inhibiting corrosion of ferrous metal surfaces exposed to nitrogen fertilizer solutions by adding an effective amount of tungstate to the nitrogen fertilizer solution. The method generally includes the steps of blending a corrosion inhibitor with a fertilizer solution containing urea, ammonium nitrate, a minor amount of water and an effective amount of tungstate, and contacting the metal surfaces with the resulting blend.

In another aspect, the present invention provides a method for inhibiting corrosion of a ferrous metal exposed to a nitrogen fertilizer solution by adding effective amounts of tungstate plus an iron stabilizer to maintain ferrous ions soluble and thereby prevent particulate iron oxide formation. The iron stabilizer is a dispersant polymer. Suitable dispersant polymers include polymers containing one or more of the following monomers: Acrylic acid; Acrylamide; t-Butyl acrylamide ; Methacrylic Acid; Itaconic Acid; Maleic Anhydride; 2-Acrylamide-2-methylpropane sulfonic acid; Styrene sulfonate; Vinyl sulfonate; Allyl glycidil ether; Allyl hydroxypropyl sulfonate ether; Polyethylene glycol allyl ether; Allyl sulfonate. In a preferred embodiment, the dispersant polymer is an Acrylic acid homopolymer; a Acrylic acid/acrylamide/acrylamido methane sulfonic acid terpolymer; or a Acrylic acid/2-acrylamide-2-methylpropane sulfonic acid copolymer. In the most preferred embodiment the dispersant polymer is a 3:1 ratio acrylamide/acrylic acid copolymer.

In another aspect, the present invention provides a method for inhibiting corrosion of a ferrous metal exposed to a nitrogen fertilizer solution by adding effective amounts of tungstate, ortho-phosphate, and an iron stabilizer to said fertilizer solution. The iron stabilizer is a dispersant polymer. Suitable dispersant polymers include polymers containing one or more of the following monomers: Acrylic acid; Acrylamide; t-Butyl acrylamide ; Methacrylic Acid; Itaconic Acid; Maleic Anhydride; 2-Acrylamide-2-methylpropane sulfonic acid; Styrene sulfonate; Vinyl sulfonate; Allyl glycidil ether; Allyl hydroxypropyl sulfonate ether; Polyethylene glycol allyl ether; Allyl sulfonate. In a preferred embodiment, the dispersant polymer is an Acrylic acid homopolymer; a Acrylic acid/acrylamide/acrylamido methane sulfonic acid terpolymer; or a Acrylic acid/2-acrylamide-2-methylpropane sulfonic acid copolymer. In the most preferred embodiment the dispersant polymer is a 3:1 ratio acrylamide/acrylic acid copolymer.

In yet another aspect of the present invention a method for inhibiting the corrosion of a ferrous metal surface exposed to a nitrogen fertilizer solution comprising the step of adding an effective amount of tungstate, ortho-phosphate, phosphonite and an iron stabilizer compound to said nitrogen fertilizer solution. The iron stabilizer is a dispersant polymer. Suitable dispersant polymers include polymers containing one or more of the following monomers: Acrylic acid; Acrylamide; t-Butyl acrylamide; Methacrylic Acid; Itaconic Acid; Maleic Anhydride; 2-Acrylamide-2-methylpropane sulfonic acid; Styrene sulfonate; Vinyl sulfonate; Allyl glycidil ether; Allyl hydroxypropyl sulfonate ether; Polyethylene glycol allyl ether; Allyl sulfonate. In a preferred embodiment, the dispersant polymer is an Acrylic acid homopolymer; a Acrylic acid/acrylamide/acrylamido methane sulfonic acid terpolymer; or a Acrylic acid/2-acrylamide-2-methylpropane sulfonic acid copolymer. In the most preferred embodiment the dispersant polymer is a 3:1 ratio acrylamide/acrylic acid copolymer.

DETAILED DESCRIPTION OF THE INVENTION

Throughout this patent application the following terms have the indicated meaning:

"Nitrogen fertilizer solution" means a fertilizer solution that at least includes ammonium nitrate.

"Iron stabilizer" means a molecule that binds with the iron that is produced as corrosion takes place to prevent particulate iron oxide formation.

"Ferrous metal" means a carbon steel or alloy steel.

The present invention is generally applicable to urea-ammonium nitrate fertilizer solutions. The UAN preferably contains a minor amount of water, i.e. less than 50 weight percent, but usually at least 20 weight percent water is necessary to maintain solubility of the urea-ammonium nitrate mixture. The UAN preferably comprises from 20 up to 50 percent water, more preferably from 20 to 25 percent water by weight.

The corrosion inhibitor is a tungstate salt formulation that is readily soluble in the nitrogen fertilizer solution or UAN at effective concentrations for inhibiting corrosion. The tungstate is non-foaming and is rendered non-sludging through the use of the iron stabilizer and by avoiding very high ortho-phosphate levels in the formulation as these can lead to forming iron phosphate or other phosphate salt particles in the nitrogen fertilizer or UAN. As used herein, non-sludging refers to the general absence of sludge formation from the nitrogen fertilizer solution or UAN over an extended period of time, e.g. several months in a storage tank. The formation of minor amounts of sludge is permissible, but the sludge should not readily form so as to require frequent cleaning of the equipment, e.g. it should not leave rings in sample bottles or tanks, which require frequent cleaning.

Similarly, the nitrogen fertilizer solution or UAN should not foam excessively, e.g. when it is transferred into or from a tank, or when sprayed in the field as a fertilizer application, such that the foaming substantially interferes with the operation. The formation of solid precipitates is similarly undesirable, and is excessive when the precipitate interferes with processing of the UAN, e.g. settling at the bottom of tanks, plugging lines and/or equipment, and the like.

The tungstate is preferably an alkali metal tungstate such as sodium, potassium or lithium tungstate, or the like. Potassium and sodium tungstate are preferred. Sodium tungstate is especially preferred because it is readily available commercially, soluble in water and nitrogen fertilizer solution or UAN, and relatively non-hazardous under recommended use conditions.

The tungstate is used in an amount that is effective to inhibit the corrosiveness of nitrogen fertilizer solution or UAN toward ferrous metal surfaces. Generally, the use of tungstates in amounts less than 5 ppm $WO_4$ by weight of the UAN solution is ineffective. There is generally no benefit to be gained by using an amount in excess of 50 ppm $WO_4$. Sodium tungstate is preferably used in an amount which gives more than 5 and less than 25 ppm $WO_4$ in the final fertilizer solution.

The corrosion inhibitor of the present invention is readily added to and blended with the nitrogen fertilizer solution or UAN using conventional blending techniques. A tank with an agitator is all that is needed, but the tungstate can also be blended by introducing a side stream of the tungstate into the UAN and allowing sufficient mixing to be generated by turbulence as the mixture flows through piping and other equipment. The tungstate can be added as a powder or granulated solid, but is preferably an aqueous solution, for example, from 5 to 38 percent by weight aqueous sodium tungstate. The tungstate can be added to the nitrogen fertilizer solution or UAN after the urea, ammonium nitrate and any water are blended, or the tungstate can be added during the blending, or separately to the urea solution, the ammonium solution, and/or any additional water. The corrosion inhibitor can be added or blended on a batch or continuous basis.

Once the tungstate inhibitor is added to the fertilizer solution, it is effectively non-corrosive and can be stored, transported, shipped, or the like in ferrous metal equipment, such as tanks, piping, containers, application equipment or the like. In particular, the inhibited nitrogen fertilizer solution or UAN can be diluted with water, generally just prior to field application as a nitrogen fertilizer for agricultural purposes.

As used herein, a nitrogen fertilizer solution or UAN solution is non-corrosive when the rate of corrosion of carbon steel in contact with the solution at ambient conditions is less than 250 microns per year (about 10 mils/year). The non-corrosive, dilute nitrogen fertilizer solution or UAN can thus be applied to cropland for agricultural purposes, with or without dilution and/or admixture with other common agricultural chemicals, using steel or other ferrous metal equipment, such as tanks, lines, pumps, spray nozzles, and the like.

The invention is illustrated by way of the following examples.

EXAMPLES

Example 1

UAN from an actual UAN production facility with a starting pH of 7.9 was used. The UAN solution aliquots of 1.2 kg were placed in a round, flat-bottomed flask within a temperature-controlled water bath. Two blank solutions had no inhibitors. Two inhibited solutions had 11 ppm $WO_4$ each. The solutions were well mixed prior to testing. The flasks were equipped with a water-cooled condenser to prevent water loss from the UAN solution. The corrosion test temperature was 50° C. The corrosion test pH of 5.3 (measured using temperature-compensated double junction pH probe) was obtained after air purging the heated solutions with a ceramic air diffuser for 24 to 48 hours. The pH is controlled at the set point of 5.3 by adding additional ammonia gas to the solution as needed. This test pH produces a very corrosive solution suitable for rapid evaluation of UAN corrosion inhibitors.

The corrosion test metallurgical specimens were rectangular 1010 mild steel coupons (laser-cut and double-disk ground), each with a total surface area of 21.81 $cm^2$. The test specimens were not chemically pre-treated. One test specimen was placed inside each flask. Corrosion rates were measured by weight loss on the coupons at the end of the test period. The coupons were rinsed with alcohol and oven-dried at 105° C. prior to final weight determinations.

After 168 hours at the specified test conditions, two "blank" solutions without any added corrosion inhibitor had an average corrosion rate of 486 mils per year (mpy). Two solutions treated with 11 ppm $WO_4$ showed an average corrosion rate of 2.0 mpy. The resulting corrosion rate reduction was therefore 99.6%.

Example 2

The same basic testing protocol as for example 1 was used. However, all flasks were treated with $Na_2WO_4$ to obtain 11 ppm $WO_4$ in each flask. Potential iron stabilizers (1-Hydroxyethylidene-1,1-Disphosphonic Acid (HEDP), Sodium Pyrophosphate, and Dispersant Polymer (3:1 Acrylamide to Acrylic Acid Copolymer)) were added for evaluation, and the solutions are well mixed prior to testing. Each test flask was run in duplicate, allow for evaluation of reproducibility of the results. Flasks were removed from the water bath once the solutions turn yellow, indicating that some iron has been generated via corrosion. The coupons were removed from the flasks. The solutions were allowed to stabilize at room temperature. Aliquots were then extracted from the flasks to measure both the soluble and total iron in the solutions. Soluble iron is defined as iron remaining in solution after passing said solution through a 0.45 micron filter. The iron test method was calorimetric analysis using the Ferrozine reagent method from Hach Inc., Loveland, CO.

Using the ratio of the soluble iron to the total iron in solution, the amount of insoluble iron was calculated for each solution. The results are shown below in Table 1. The dispersant polymer is highly effective. The phosphonate (HEDP) is marginally effective at best relative to the blank. The polyphosphate (pyrophosphate) is not effective.

TABLE 1

| | Stabilizer Dose (mg/kg) | Insoluble Iron (%, Avg.) | Standard Deviation |
|---|---|---|---|
| Blank | 0 | 22% | 1% |
| HEDP | 10 | 18% | 2% |
| Pyrophosphate | 10 | 29% | 1% |
| Dispersant polymer | 10 | 0% | 4% |

What is claimed is:

1. A method for inhibiting corrosion of a ferrous metal surface exposed to a nitrogen fertilizer solution, the method comprising: adding an effective amount of an alkali metal tungstate and an effective amount of an iron stabilizer to said nitrogen fertilizer solution; optionally adding an effective amount of ortho-phosphate; and/or optionally adding an effective amount of phosphorilte.

2. The method of claim 1 wherein said nitrogen fertilizer solution is a urea ammonium nitrate solution.

3. The method of claim 1 wherein said tungstate is selected from the group consisting of sodium tungstate, potassium tungstate, and lithium tungstate.

4. The method of claim 1 wherein said iron stabilizer is a dispersant polymer.

5. The method of claim 4 wherein said dispersant polymer is an acrylic acid homopolymer and/or an acrylic acid/acrylamide/acrylamido methane sulfonic acid terpolymer.

6. The method of claim 4 wherein said dispersant polymer includes one or more monomers selected from the group consisting of: acrylic acid; acrylamide; t-Butyl acrylamide; methacrylic acid; itaconic acid; maleic anhydride; 2-Acrylamide-2-methylpropane sulfonic acid; styrene sulfonate; vinyl sulfonate; allyl glycidil ether; allyl hydroxypropyl sulfonate ether; polyethylene glycol allyl ether; allyl sulfonate.

7. The method of claim 4 wherein said dispersant polymer is a 3:1 ratio of acrylamide to acrylic acid copolymer.

8. The method of claim 1 comprising the step of adding an effective amount of said tungstate, said iron stabilizer, and said ortho-phosphate to said nitrogen fertilizer solution.

9. The method of claim 1 comprising the step of adding an effective amount of said tungstate, said iron stabilizer, said ortho-phosphate, and said phosphonite to said nitrogen fertilizer solution.

10. The method of claim 1, including continuously adding the alkali metal tungstate and the iron stabilizer to the nitrogen fertilizer solution.

11. The method of claim 10, including continuously adding the ortho-phosphate and/or the phosphonite to the nitrogen fertilizer solution.

12. The method of claim 1, including adding the alkali metal tungstate and the iron stabilizer to the nitrogen fertilizer solution on a batch basis.

13. The method of claim 12, including adding the ortho-phosphate and/or the phosphonite to the nitrogen fertilizer solution on a batch basis.

14. A method for inhibiting corrosion of a ferrous metal surface exposed to a nitrogen fertilizer solution, the method comprising: adding an effective amount of an alkali metal tungstate to said nitrogen fertilizer solution; optionally and an effective amount of an iron stabilizer; optionally adding an effective amount of ortho-phosphate; and/or optionally adding an effective amount of phosphonite.

15. The method of claim 14, including adding from 5 ppm $WO_4$ to 50 ppm $WO_4$.

16. The method of claim 14, wherein the alkali metal tungstate is a powder or granulated solid.

17. The method of claim 14, wherein the alkali metal tungstate is an aqueous solution from 5 to 38 weight percent.

18. A method for inhibiting corrosion of a ferrous metal surface exposed to a nitrogen fertilizer solution, the method comprising; adding to said nitrogen fertilizer solution an effective amount of an alkali metal tungstate and effective amount of an iron stabilizer, the iron stabilizer being a dispersant polymer including an acrylic acid/acrylamide/acrylamido methane sulfonic acid terpolymer and/or a 3:1 ratio of acrylamide to acrylic acid copolymer; optionally adding an effective amount of orthophosphate; and/or optionally adding an effective amount of phosphonite.

* * * * *